US006116434A

United States Patent [19]

Park

[11] Patent Number: 6,116,434

[45] Date of Patent: Sep. 12, 2000

[54] ARTICLE HOLDER AND ORGANIZER

[76] Inventor: Hong Ku Park, 203 Southcrest Dr., Huntsville, Ala. 35802

[21] Appl. No.: 09/026,954

[22] Filed: Feb. 20, 1998

[51] Int. Cl.[7] ..... A47G 29/00

[52] U.S. Cl. ..... 211/71.01; 211/85.23; 211/90.01

[58] Field of Search ..... 211/71.01, 72, 211/85.18, 85.23, 88.01, 88.03, 90.01, 99, 104

[56] References Cited

U.S. PATENT DOCUMENTS

| | | | |
|---|---|---|---|
| 122,855 | 1/1872 | Rudiger | 211/90.01 |
| 507,233 | 10/1893 | Marshall | 211/88.01 X |
| 559,744 | 5/1896 | Price | 211/99 X |
| 611,503 | 9/1898 | Parker | 211/104 |
| 933,643 | 9/1909 | Gnekow | 211/88.03 |
| 1,098,818 | 6/1914 | McLane | 211/88.01 X |
| 1,863,471 | 6/1932 | Colaizzi | 211/88.01 |
| 1,975,691 | 10/1934 | Hibbs | 211/88.01 X |
| 1,989,294 | 1/1935 | Serpico | 211/88.03 X |
| 2,230,975 | 2/1941 | Gratz | 211/85.18 X |
| 2,282,661 | 4/1942 | Lewis | 211/71.01 X |
| 2,559,102 | 7/1951 | Zukor | 211/90.01 X |
| 2,662,645 | 12/1953 | Piton | 211/104 X |
| 2,702,639 | 2/1955 | Eck | 211/90.01 |
| 2,718,874 | 9/1955 | Dunn | 211/90.01 X |
| 2,815,863 | 12/1957 | Larson | 211/90.01 X |
| 2,889,052 | 6/1959 | O'Neill | 211/104 |
| 2,932,544 | 4/1960 | Lambert | 211/88.01 X |
| 3,145,848 | 8/1964 | Wood | 211/88.01 |
| 3,469,711 | 9/1969 | Swaneck et al. | 211/71.01 X |
| 3,606,949 | 9/1971 | Joyce | 211/88.01 X |
| 3,645,486 | 2/1972 | Ferdinand et al. | 211/90.01 X |
| 3,909,041 | 9/1975 | Medgebow | 211/72 |
| 4,008,808 | 2/1977 | Ramsey | 211/88.01 X |
| 4,300,692 | 11/1981 | Moreno | 211/94 |
| 4,793,097 | 12/1988 | Whitcomb | 211/72 X |
| 4,907,705 | 3/1990 | Waldeck | 211/72 X |
| 5,024,705 | 6/1991 | Cahill | 211/74 X |
| 5,141,117 | 8/1992 | Olsen et al. | 211/71.01 |
| 5,362,077 | 11/1994 | Adamson | 211/71.01 X |
| 5,397,006 | 3/1995 | Terrell | 211/88.01 |
| 5,480,058 | 1/1996 | Hutchins | 211/88.01 X |
| 5,641,074 | 6/1997 | Smed | 211/88.01 X |
| 5,704,495 | 1/1998 | Bale et al. | 211/71.01 |
| 5,711,435 | 1/1998 | Morison et al. | 211/90.01 |

*Primary Examiner*—Daniel P. Stodola
*Attorney, Agent, or Firm*—Waddey & Patterson; John C. Garvin, Jr.

[57] ABSTRACT

An apparatus for holding and organizing a variety of articles such as plants, tools, implements and the like. The article holder and organizer generally comprises a plurality of wall brackets, a shelf, a plurality of first suspension elements, a plurality of second suspension elements, a plurality of containers for holding or organizing a variety of articles or plants, and a plurality of insert rings for supporting a respective container within an opening in the shelf.

13 Claims, 2 Drawing Sheets

ARTICLE HOLDER AND ORGANIZER

FIELD OF THE INVENTION

This invention relates generally to an article holder and organizer and more particularly to such a holder and organizer which can accommodate a variety of articles such as plants, tools, implements, books, ornamental objects and the like.

BACKGROUND OF THE INVENTION

The prior art abounds with devices for hanging onto a structure for holding and organizing various objects such as plants, tools, books, containers, supplies and the like. Numerous such prior art devices are disclosed in United States patents as exemplified by Pat. No. 3,023,891 to Sutter; 3,737,131 to Larson; 4,452,361 to Harris; 5,205,422 to Morris; 5,350,071 to Pond; and 5,564,566 to Lamb.

The Sutter patent discloses a device having numerous openings therein whose walls support jars which store small parts, bolts, nuts and the like as well as numerous openings whose walls support hand tools. The Larson patent discloses a device for use on an pegboard and which includes numerous openings whose walls support a variety of hand tools. The Harris patent discloses a rack for holding and organizing a plurality of pneumatic tools, which rack is secured to a vertical supporting surface by means of a plurality of braces and bolts. The patent to Morris discloses a holder for rotary power handsaws, which holder is secured to a vertical surface by a plurality of screws. The patent to Pond discloses a tray for holding numerous tools and supplies to be used by tradesman and which is suspended from an overhead structure by a pair of suspension members. The patent to Lamb discloses an outdoor faucet organizing basket for holding miscellaneous gardening tools adjacent an outdoor faucet.

While there are numerous article holders and organizers in the prior art, including those disclosed in the above-identified United States patents, most are complex, and all suffer from numerous deficiencies and disadvantages. The present invention overcomes these deficiencies and disadvantages in that it provides an improved article holder and organizer that fills the need for a simple, inexpensive, holder and organizer made from readily available materials which can be easily assembled by persons with little, if any, mechanical skills.

SUMMARY OF THE INVENTION

The article holder and organizer of the present invention in one embodiment generally comprises a plurality of wall brackets, a shelf, a plurality of first suspension elements, and a plurality of second suspension elements for supporting articles such as books or ornamental objects. In other embodiments, the article holder and organizer further includes one or more containers for holding or organizing a variety of articles or plants, and one or more insert rings for supporting a respective container within an opening in the shelf.

It is an object of the present invention to provide a new and improved article holder and organizer which has the advantages of the prior art devices and none of the disadvantages.

It is a further object of the present invention to provide a new and improved article holder and organizer which may be easily and efficiently manufactured from inexpensive and readily available materials.

It is yet a further object of the present invention to provide a new and improved supporting device for containers which hold plants, tools, books, ornamental objects and the like which is constructed to occupy minimum space in shipping and storage.

It is an additional object of the present invention to provide a new and improved supporting device comprising one or more shelves for supporting containers for a variety of articles which is inexpensive, readily adaptable for workshop and other uses, which requires minimum space for shipment and storage and in use, and which fulfills the objects and advantages sought therefor.

Other objects, features and advantages of the present invention will become apparent from the following detailed description and from the appended drawings in which like numbers have been used to described like parts throughout the several views.

DESCRIPTION OF THE PREFERRED EMBODIMENTS

Figure 1:
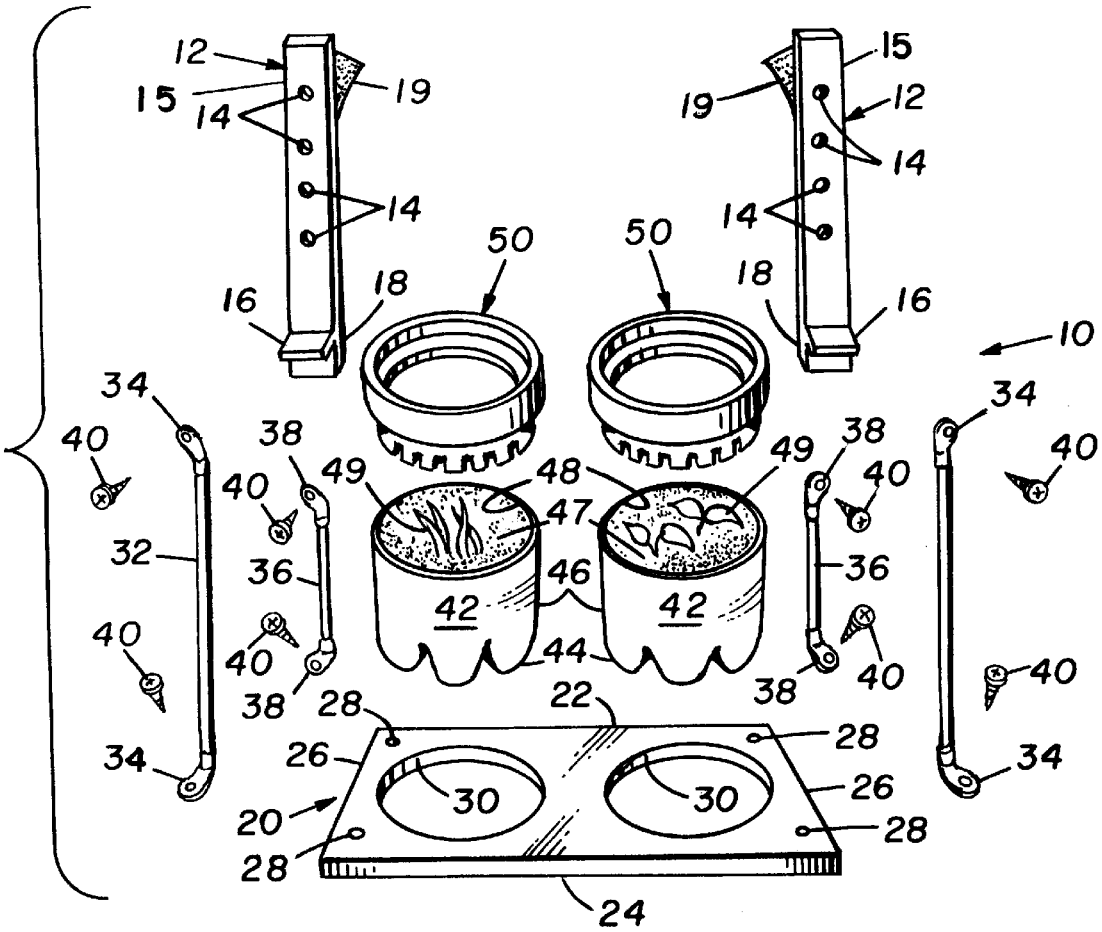
FIG. 1 is an exploded, perspective, view of the holder and organizer of the present invention having plants growing therein.

Referring now to the drawings, wherein like numerals represents like parts throughout, reference numeral 10 generally designates the article holder and organizer of the present invention. Article holder and organizer 10 generally comprises a plurality of wall brackets 12, a shelf 20, a plurality of first suspension filaments 32, a plurality of second suspension filaments 36, a plurality of containers 42 for holding a variety of articles, and a plurality of insert rings 50 for supporting a respective container. Each wall bracket 12 is elongated and has a an upper end 15 and a lower end 18, a rear surface (not numbered), an inner surface (unnumbered), a plurality of openings 14 extending between the outer surface and the inner surface and a protruding ledge 16 extending from the lower end 18 of wall bracket 12. A conventional adhesive (unnumbered) is applied to the back surface of each wall bracket 12 for securing the brackets 12 to a vertical surface (not shown) and a backing 19 protects the adhesive when the wall brackets 12 are not secured to a wall. The shelf 20 is preferably made of wood and is generally rectangular and includes an inner edge 22, an outer edge 24, a pair of side edges 26, a pair of small pilot holes 30 adjacent each side edge 26, and one or more large openings 30 between inner edge 22 and outer edge 24. Each first suspension filament 32 includes a first end (unnumbered) and a second end (unnumbered), each having an eyelet 34 secured thereto by any conventional means such as crimping or an adhesive with a hole (unnumbered) therein. Each second suspension filament 36 includes a first end (unnumbered) and a second end (unnumbered), each having an eyelet 38 secured thereto by any conventional means such as crimping or an adhesive with a hole (unnumbered) therein. The suspension elements 32 and 36 are preferably made from a flexible material such as a soft plastic, nylon, a small rope or the like. A plurality of wood screws 40 are provided for connecting the eyelets 34 and 38 on the end portions of first and second filaments 32 and 36 respectively to the pilot holes 28 in shelf 20 and openings 14 in respective wall brackets 12. Each container 42 is cup-shaped with a bottom 44, a side wall 46, and an upper opening 48.

Figure 2:
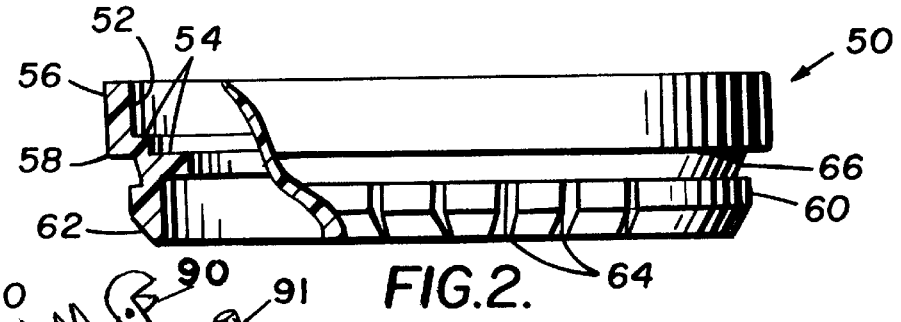
FIG. 2 is a front elevational, partially cross-sectional, view of the insert ring used in the present invention.

As best shown in FIG. 1, each container 42 has soil 47 and one or more plants or sproutings 49 therein. As best shown in FIG. 2, insert ring 50 includes a central opening 52; two internal annular shoulders 54; an upper annular portion 56; an external annular shoulder 58; a lower annular portion 60 having a tapered section 62 and a plurality of slits 64; and an external annular groove 66.

The holder and organizer 10 as depicted in FIG. 1 might be assembled in the following steps as well as other possible steps.

a. Backing 19 is removed from the back surface of each wall bracket 12 and each wall bracket 12 is secured to a vertical wall (not shown) through the adhesive on the back surface of each wall bracket 12 during which time particular attention is directed to horizontally aligning the ledges 16 which protrude from the lower end 18 of each wall bracket 12.

b. A screw 40 is placed within the hole in each eyelet 38 attached to each upper end of respective second suspension filament 36 and into an appropriate opening 14 in a respective wall bracket 12 and tightened to secure each second suspension element 36 to a respective wall bracket 12.

c. A screw 40 is next placed within the hole in each eyelet 34 attached to each lower end of respective first suspension filament 32 and into an appropriate opening 14 in a respective wall bracket 12 and tightened to secure each first suspension element 32 to a respective wall bracket 12.

d. The inner edge 22 of shelf 20 is placed upon the protruding ledges 16 of each wall bracket 12 and a screw 40 is placed within the hole in each eyelet 38 attached to each lower end of respective second suspension filament 36 and into the pilot hole 28 adjacent inner edge 22 and side edges 26 of shelf 20 and tightened with a screwdriver to secure each second suspension filament 36 adjacent the side edges 26 of shelf 20.

e. A screw 40 is placed within the hole in each eyelet 34 attached to the lower end of first suspension element 32 and into the pilot hole 28 adjacent outer edge 24 and side edges 26 of shelf 20 and tightened with a screwdriver to secure each first suspension filament 32 adjacent the side edges 26 of shelf 20.

f. Each container 42, with an insert ring 50 already secured thereto by a friction fit between the lower annular portion 60 of the insert ring 50 with the inner wall of upper opening 48 of container 42, is next placed within a respective large opening 30 in shelf 30 and held therein by the engagement of the external annular shoulder 58 of insert ring 50 with the upper surface of shelf 20 which surrounds the large openings 30.

g. The soil 47 and plants or sproutings 49 are then placed within each container 42.

Figure 4:
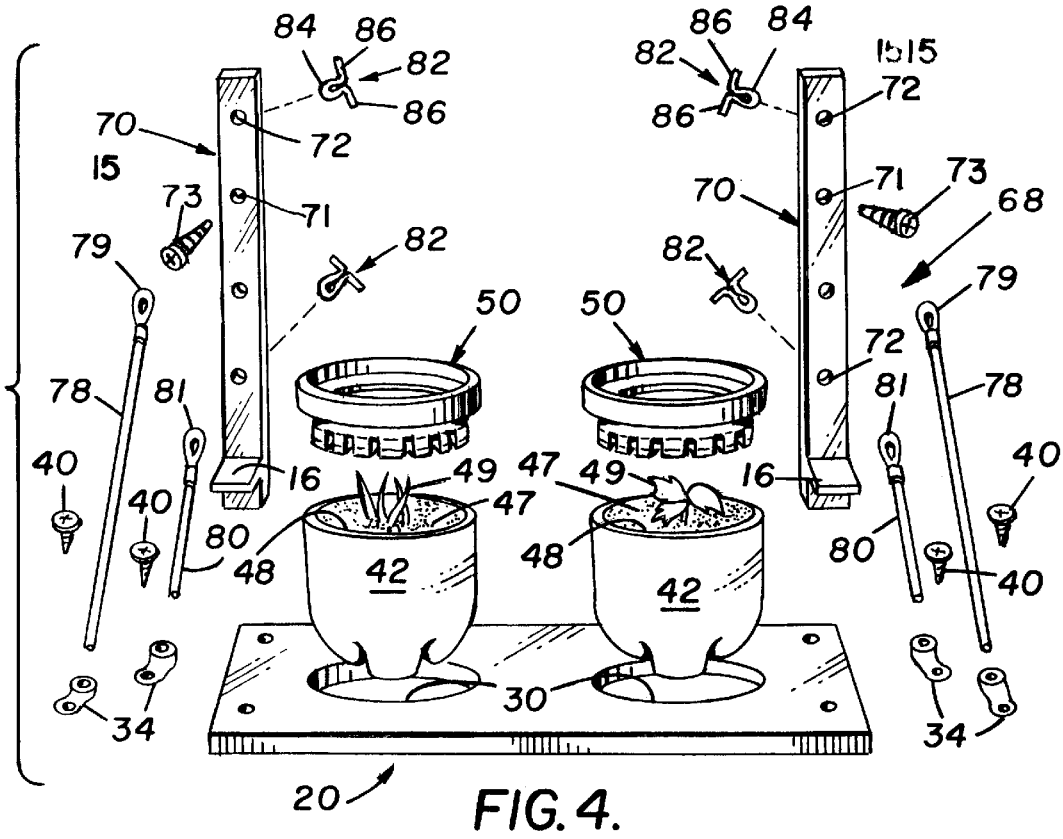
FIG. 4 is an exploded, perspective, view of a second embodiment of the holder and organizer of the present invention having plants growing therein.
Figure 5:
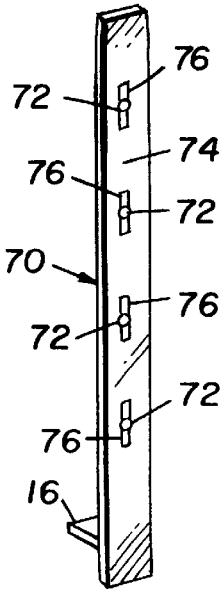
FIG. 5 is a perspective view showing the back surface and protruding ledge of the wall brackets used in the second embodiment of the holder and organizer as depicted in FIG. 4.

A second embodiment of the holder or organizer of the present invention is illustrated in FIGS. 4 and 5 and is generally designated by the reference numeral 68. Holder or organizer 68 comprises a pair of elongated wall brackets 70, a shelf 20, a plurality of first suspension filament 78, a plurality of second suspension filaments 80, a plurality of containers 42, and a plurality of clips 82. Each wall bracket 70 includes a front surface (unnumbered); a rear surface 74 with a plurality of elongated indentations 76; and a plurality of openings 72 which extend between the front surface and a respective indentation in the rear surface 74. Each first suspension filament 78 includes two end portions (unnumbered) with one end portion having a flexible eyelet 78 secured thereto by any conventional means such as an adhesive and the other end portion having an eyelet 34 secured thereto by any conventional means such as an adhesive or crimping. Each second suspension filament 80 includes two end portions (unnumbered), one end portion having a flexible eyelet 81 secured thereto by any conventional means such as an adhesive and the other end portion having an eyelet 34 secured thereto by any conventional means such as an adhesive or crimping. Each clip 82 includes a central portion 84 and a pair of legs 86. The suspension elements 78 and 80 and the eyelets 79 and 81 are preferably made from a flexible material such as a soft plastic, nylon, a small rope or the like. The embodiment depicted in FIG. 4 differs from that depicted in FIG. 1 primarily in that:

a. The upper end of each of the first and second suspension filaments 78 and 80 have a flexible eyelet 79 and 81 respectively attached thereto in lieu of conventional metallic eyelets 34 and 38.

b. The use of clips 82 for receiving the flexible eyelets 79 and 81 thereover to secure the upper ends of first and second suspension filaments 78 and 80 to the wall brackets 70 in lieu of screws 40.

c. The use of one or more screws 73 for passing through holes 71 in wall brackets 70 for securing the wall brackets 70 to a vertical wall (not shown).

As is apparent, the embodiment of the invention depicted in FIG. 4 may be assembled in a manner similar to that set forth for the embodiment of FIG. 1.

Figure 3:
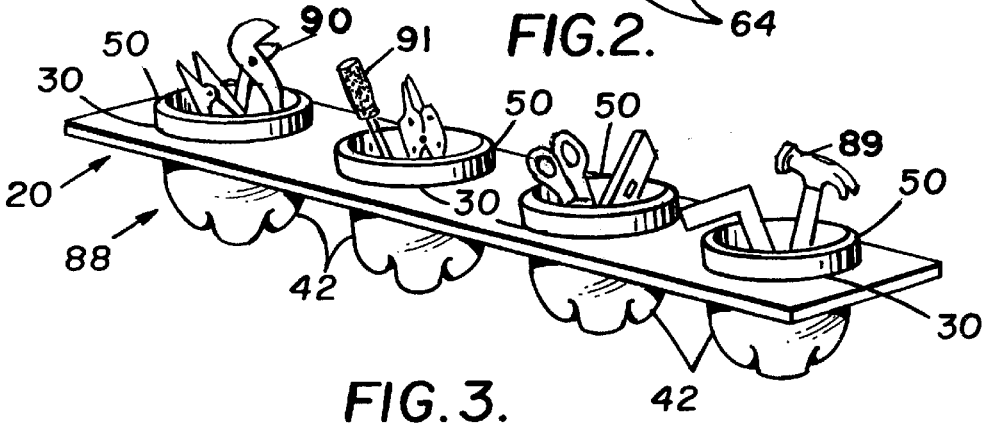
FIG. 3 is a perspective view of a portion of the holder and organizer of the present invention having tools organized therein.

A third embodiment of the holder or organizer of the present invention is illustrated in FIG. 3 and used for holding and organizing tools such as hammers 89, pliers 90, screw drivers 91 and the like. The shelf 20 for the embodiment depicted in FIG. 3 is identical to that depicted in the embodiment of FIGS. 1 and 4. While the suspension filaments, wall brackets and their associated structures are not depicted in FIG. 3, it is apparent that they may be the same as the structures depicted in either FIG. 1 or FIG. 4.

Figure 6:
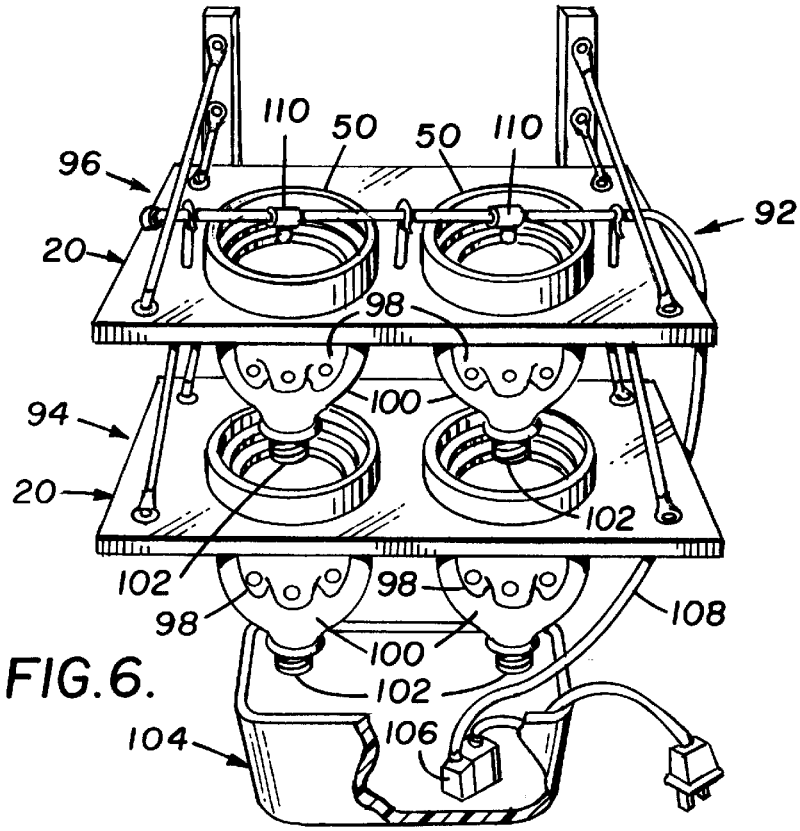
FIG. 6 is a front perspective view of a third embodiment of the holder and organizer of the present invention depicting holders or organizers in a two tier arrangement and in an environment wherein plants or sprouting can be continuously watered.

A fourth embodiment of the holder or organizer of the present invention is illustrated in FIG. 6 and is designated generally by the reference numeral 92. Holder or organizer 92 comprises a lower tier 94, an upper tier 96, a pan 104, an electric pump 106, a flexible hose 108 having one end (unnumbered) connected to electric pump 106, and a plurality of nozzles 110 in flexible hose 108 adjacent one end thereof. Each of lower tier 94 and upper tier 96 has two inner containers 98 which have a plurality of holes (unnumbered) in it bottom and two outer containers 100, each of which has a single opening 102 in its lower end. The structure of the shelves 20, the first and second suspensions filaments (unnumbered), the eyelets (unnumbered), and wall brackets (unnumbered) depicted in the embodiment of FIG. 6 may be the same or very similar to the structures set forth in either FIG. 1 or FIG. 4. The embodiment of the holder and organizer 92 disclosed in FIG. 6 may be used to continuously water sproutings (not shown) to be grown in inner containers 98 and allows water and possibly minerals stored in pan 104 to be continuously pumped by electric pump 106 through the flexible hose 108; the nozzles 110; the soil (not shown) in inner containers 98, the openings (unnumbered) in inner containers 98, and the opening 102 in the outer containers 100 in the upper tier 96; and through the soil (not shown) in inner containers 98, the openings (unnumbered) in inner containers 98, and the openings 102 in the outer containers in lower tier 94; and back into the pan 104.

Since the suspension elements 32, 36, 78 and 80 are made from a flexible material such as a soft plastic, nylon, a small rope, or the like, the shelf 20 will swing side ways or upwardly or give if someone might walk into the article holder or organizer 10 or 68. This feature will diminish possible injury to a person who might walk or bump into the article holder or organizer.

The foregoing is provided for purposes of illustration, explanation, and description of the preferred embodiments of the present invention. Modifications, variations and adaptations of these embodiments will be apparent to those of ordinary skill in the art and they may be made without departing from the scope or spirit of the invention. For example, the containers 42 and insert rings 50 could be omitted so that articles such as books could be placed on the shelf 20 in all embodiments other than that depicted in FIG. 6. Furthermore, the openings 30 in shelf 20 could be omitted if a user desires that the invention hold books or ornamental articles.

I claim:

1. An article holder and organizer for mounting on a vertically disposed wall, said holder and organizer comprising:

a pair of wall brackets, each having an upper end and a lower end, and means for securing each said wall bracket to the vertically disposed wall;

at least one shelf having an upper surface, a bottom surface, an inner edge, an outer edge, and two side edges, each said side edge having two holes adjacent thereto;

a ledge protruding from each said lower end of each said wall bracket for engaging said bottom surface of said at least one shelf beneath a portion of its said inner edge for partially supporting said shelf in a generally horizontal position;

a pair of first flexible filaments, each having a first end and a second end;

means for securing said first end of each said first flexible filament to each of said wall brackets;

means for securing said second end of each said first flexible filament to said at least one shelf at the point of location of one of said holes located adjacent to one of said side edges of said at least one shelf;

a pair of second flexible filaments, each having a first end and a second end;

means for securing said first end of each said second flexible filament to each of said wall brackets; and means for securing said second end of each said second flexible filament to said at least one shelf at the point of location of the other of said holes located adjacent to one of said side edges of said shelf;

each of said first and second pairs of flexible filaments partially support said at least one shelf in a generally horizontal position.

2. The article holder and organizer of claim 1 wherein said means for securing said first and second ends of said first and second filaments to each of said wall brackets and to said at least one shelf includes a pair of eyelets.

3. The article holder and organizer of claim 1 wherein said at least one shelf includes a center point and at least two openings symmetrically located with respect to said center point, and further including means positioned in each of said openings for holding and organizing a variety of articles, said means including an insert ring and a container.

4. The article holder and organizer of claim 3 wherein each said wall bracket further includes front and rear surfaces, at least two indentations in said rear surface, and at least two openings extending between said front surface and a respective said indentation.

5. The article holder and organizer of claim 4 wherein each said means for securing said first ends of said first and second filaments to each of said wall brackets further includes a clip having a central portion and a pair of legs which fit within a respective said indentation and wherein a flexible eyelet is secured to each of said first ends of each said first and second flexible filament, with each said flexible eyelet being adapted to be placed over and secured to said central portion of a respective said clip.

6. The article holder and organizer of claim 3 wherein said container includes a bottom, a sidewall and an upper opening.

7. The article holder and organizer of claim 6 wherein each said insert ring has a central opening and a lower annular portion having a plurality of slits therein adapted to fit within said upper opening of a respective said container.

8. The article holder and organizer of claim 7 wherein said means for securing said wall brackets to the vertically disposed wall includes an adhesive.

9. The article holder and organizer of claim 3 further comprising:

at least one second shelf positioned above said at least one first shelf; said at least one second shelf including a center point and at least two openings symmetrically located with respect to said center point;

means positioned in each of said openings in said at least one second shelf for holding a variety of articles; and means for supporting said at least one second shelf in a generally horizontal position.

10. A plant holder and organizer for mounting on a vertically disposed wall, said plant holder and organizer comprising:

a pair of wall brackets, each having an upper end and a lower end, and means for securing each said wall bracket to the vertically disposed wall;

at least one shelf having an upper surface, a bottom surface, an inner edge, an outer edge, and two side edges, each said side edge having two holes adjacent thereto, said at least one shelf includes a center point and at least two openings symmetrically located with respect to said center point, and further including means positioned in each of said openings for holding and organizing at least one plant, said means including an insert ring and a container;

a ledge protruding from each said lower end of each said wall bracket for engaging said bottom surface of said at least one shelf beneath a portion of its said inner edge for partially supporting said at least one shelf in a generally horizontal position;

a pair of first flexible filaments, each having a first end and a second end;

means for securing said first end of each said first flexible filament to each of said wall brackets;

means for securing said second end of each said first flexible filament to said at least one shelf at the point of location of one of said holes located adjacent to one of said side edges of said at least one shelf;

a pair of second flexible filaments, each having a first end and a second end;

means for securing said first end of each said second flexible filament to each of said wall brackets; and means for securing said second end of each said second flexible filament to said at least one shelf at the point of location of the other of said holes located adjacent to one of said side edges of said at least one shelf;

each of said first and second pairs of flexible filaments partially support said at least one shelf in a generally horizontal position.

11. The plant holder and organizer of claim 10 further comprising means for continuously providing moisture to said plants.

12. The plant holder and organizer of claim 11 wherein said means for continuously providing moisture to said plants includes a hose having a nozzle therein positioned above each said plant.

13. The plant holder and organizer of claim 10 further comprising:

at least one second shelf positioned above said at least one shelf; said at least one second shelf including a center point and at least two openings symmetrically located with respect to said center point;

means positioned in each of said openings in said at least one second shelf for holding said at least a second plant; and means for supporting at least one second shelf in a generally horizontal position.

* * * * *